US005984022A

United States Patent [19]

Harman, Jr. et al.

[11] Patent Number: 5,984,022

[45] Date of Patent: Nov. 16, 1999

[54] AUTOMATIC SHAFT LOCK

[75] Inventors: William G. Harman, Jr., Glenn Rock, Pa.; Michael F. Cannaliato, Abingdon; Dale K. Wheeler, Fallston, both of Md.

[73] Assignee: Black & Decker Inc., Newark, Del.

[21] Appl. No.: 09/112,728

[22] Filed: Jul. 9, 1998

[51] Int. Cl.[6] ..... B25B 17/00

[52] U.S. Cl. ..... 173/176; 173/178; 173/216; 81/57.1; 81/59.1; 81/474

[58] Field of Search ..... 173/176, 178, 173/216, 217; 81/59.1, 57.11, 57.14, 57.31, 473, 474, 469

[56] References Cited

U.S. PATENT DOCUMENTS

| | | | |
|---|---|---|---|
| Re. 35,617 | 9/1997 | Krivec . | |
| 1,016,838 | 2/1912 | Luce . | |
| 2,249,464 | 7/1941 | Etten . | |
| 2,408,365 | 10/1946 | Biehl et al. . | |
| 3,110,381 | 11/1963 | Leu . | |
| 3,240,300 | 3/1966 | McKay . | |
| 3,243,023 | 3/1966 | Boyden . | |
| 3,477,521 | 11/1969 | Kiester et al. . | |
| 3,802,518 | 4/1974 | Albert . | |
| 4,253,554 | 3/1981 | Nisenson . | |
| 4,265,347 | 5/1981 | Dischler . | |
| 4,441,378 | 4/1984 | Ponczek . | |
| 4,448,098 | 5/1984 | Totsu . | |
| 4,522,270 | 6/1985 | Kishi . | |
| 4,653,358 | 3/1987 | Lankry . | |
| 4,691,786 | 9/1987 | Fujita et al. | 173/176 |
| 4,706,791 | 11/1987 | Magliano . | |
| 4,883,130 | 11/1989 | Dixon . | |
| 5,016,501 | 5/1991 | Holzer, Jr. . | |
| 5,054,588 | 10/1991 | Thorp et al. | 173/178 |
| 5,105,924 | 4/1992 | Carlson . | |
| 5,134,909 | 8/1992 | Sasaki . | |
| 5,248,017 | 9/1993 | Schwarzbich . | |
| 5,385,512 | 1/1995 | Moolenaar et al. | 173/176 |
| 5,406,866 | 4/1995 | Badiali . | |
| 5,499,559 | 3/1996 | Lin . | |
| 5,540,629 | 7/1996 | Gotman . | |
| 5,586,631 | 12/1996 | Benthin . | |
| 5,593,210 | 1/1997 | Schwarzbich . | |
| 5,624,013 | 4/1997 | Tsai . | |
| 5,632,186 | 5/1997 | Lin . | |
| 5,651,294 | 7/1997 | Shiao . | |
| 5,653,294 | 8/1997 | Thurler | 173/216 |
| 5,692,575 | 12/1997 | Hellstrom | 173/216 |
| 5,730,232 | 3/1998 | Mixer | 173/176 |

*Primary Examiner*—Scott A. Smith
*Attorney, Agent, or Firm*—Harness, Dickey & Pierce, P.L.C.

[57] ABSTRACT

An automatic shaft lock is incorporated into the transmission or drive components of a power driving tool of the type commonly used to tighten or loosen threaded fasteners, for example. The automatic shaft lock operates to prevent an externally-applied rotational back-force or back-torque, such as results from use of the tool to manually tighten or loosen a fastener, from being transmitted all the way through the drive components to the tool's motor or armature shaft. The shaft lock also effectively reduces the amount of back-torque, functioning automatically in either rotational direction, due to being disposed at an intermediate location in the drive train, between an intermediate gear enmeshed for driving rotation with the tool's armature shaft and an output gear enmeshed in a driving relationship with the tool's output shaft.

13 Claims, 5 Drawing Sheets

AUTOMATIC SHAFT LOCK

BACKGROUND AND SUMMARY OF THE INVENTION

The present invention relates generally to automatic locking mechanisms for power driven shafts. The invention is particularly well-suited for application in power tools, especially those of the hand-held variety used for driving threaded fasteners into a workpiece, for example.

Power tools such as power screwdrivers, nut drivers, and other such fastener drivers have become widely used for power-driving threaded fasteners into a workpiece or for driving one threaded fastener onto or into another threaded fastener. Sometimes, though, due to the size, length, or condition of the threaded fastener, such power driving tools lack sufficient torque to tighten (or loosen) the threaded fasteners to the full extent desired by the operator. In such instances, operators frequently use the power driving tool in a de-energized state or in a locked-armature condition to forcibly manually tighten the fastener. Also, in some cases, operators use the tool to manually set a fastener in order to more precisely control the final amount of torque applied to the fastener.

While such manual torque-applying usages are well known and common, they can sometimes result in damage to the power tool in the form of bent or broken internal drive components or even possible electrical damage to the power tool's motor. In addition, if the operator uses the power tool to manually tighten a fastener when the motor is de-energized, the back-applied torque can cause slippage in various drive components or can otherwise be less than fully effectual to allow the operator to manually tighten (or loosen) the fastener.

Accordingly, various shaft lock mechanisms and designs have been provided in hand-held power tools to alleviate these problems or to aid in manual torque-applying operations. One example of which, wherein the shaft lock mechanism is on the power tool's output shaft, is shown in U.S. Pat. No. 5,016,501, granted to Holzer in 1991. However, many of these mechanisms have themselves proved disadvantageous in that large or excessive amount of manually-applied back-torque can damage or break the shaft lock mechanisms themselves. The present invention, therefore, seeks to provide an automatic shaft lock mechanism that substantially prevents the transmission of back-torque during manual tightening operations in ways that could result in component breakage, motor damage, or slippage. The present invention also seeks to provide such a shaft lock mechanism that is not located at the tool's output shaft and that can thus take advantage of the tool's output gearing and thus be sturdier and more effective.

In accordance with one preferred example of the present invention, an interlock mechanism including an automatic shaft lock apparatus is provided for a power tool having a housing, a longitudinally-extending or axially-extending rotatable armature shaft enmeshed (either itself or through a pinion gear) with an intermediate gear disposed within the housing for rotation in response to rotation of the armature shaft, and an intermediate shaft disposed in the housing for rotation therein and rotationally interconnected with the tool's bit-holding chuck. The interlock mechanism drivingly and rotationally interconnects the intermediate shaft with the intermediate gear in order to cause bidirectional "forward-torque" rotation of the intermediate shaft in one of two directions in response to corresponding rotation of the intermediate gear, while the automatic shaft lock portion of the interlock mechanism prevents rotation of the intermediate gear in response to an external rotational force imposed on the intermediate shaft in a second opposite or "back-torque" direction.

In order to accomplish this, the automatic shaft lock includes a hollow cylindrical cavity formed in a fixed portion of the housing, preferably in the form of a hollow cylindrical cavity (with or without an internal wear sleeve) carried by a fixed bearing plate in the housing, with the hollow cylindrical cavity being radially offset relative to the armature shaft and having a cylindrical interior cavity surface therein. At least one drive lug (and preferably more than one) is fixedly disposed on the intermediate gear for concentric rotation therewith and extends longitudinally or axially into the hollow cylindrical cavity at the radial periphery thereof, with each of the preferred drive lugs having a drive projection extending radially inwardly.

An anvil is fixedly disposed (such as by press-fit, for example) on the intermediate shaft for concentric rotation therewith and is disposed within the hollow cylindrical cavity.

The anvil has an external diameter smaller than the diameter of the interior cavity surface of the hollow cylindrical cavity and has at least one, and preferably more than one, longitudinally-extending anvil channels recessed radially inwardly therein for interlockingly receiving the radially inwardly extending drive projections therein in a driving relationship therewith. The anvil channels have a circumferential width greater than the circumferential width of the drive projection in order to permit a predetermined amount of limited relative rotation therebetween. The anvil, adjacent drive lugs, and the interior cavity surface of the hollow cylindrical cavity together form a chamber within the cylindrical cavity, within which at least one longitudinally-extending cylindrical locking pin is disposed, resting between the anvil and the interior cavity surface of the hollow cylindrical cavity and between circumferential sides of the adjacent drive lugs.

The preferred anvil has a radially inwardly recessed flat portion between each of the adjacent pairs of anvil channels such that there is more radial clearance for the locking pin (between the interior cavity surface and the anvil) at a generally intermediate location of the chamber (between the anvil channels) than there is at the circumferential ends of the chamber, closely adjacent the anvil channels, where the pin or pins become radially "pinched" between radially outwardly-raised portions or radially outwardly-protruding "bosses" on either circumferential side of each of the anvil channels. The locking pins and the anvil are free to rotate in response to interlocking rotation of the drive lugs, the intermediate gear, and the anvil, in response to forward-torque rotation of the intermediate gear being driven (in either rotational direction) by rotation of the armature shaft, with the locking pins being urged and engaged by circumferential sides of the drive lugs to maintain them in the radially relatively unrestricted area defined by the above-mentioned flat anvil portions and the cavity inner surface. The pins, however, become radially wedged or pinched between the anvil boss surfaces closely adjacent the channels and the interior cavity surface in response to an externally-applied rotational back-force or back-torque imposed on the intermediate shaft when the intermediate gear and the armature shaft are rotationally stationary, or in response to such back-torque imposed in an opposite direction from the direction of the rotational force on the intermediate shaft imposed by the armature shaft, the intermediate gear, the drive lug, and the anvil when such external rotational back-torque is being imposed on the intermediate shaft of an energized power tool. In either case, the automatic shaft lock prevents transmission of the external rotational back-force and consequent back-torque from being imposed from the intermediate shaft and the anvil to the intermediate gear and the armature shaft. The automatic shaft lock of the present invention functions equally in either rotational direction.

It should be emphasized that such back-torque imposed on the tool's output shaft is reduced by virtue of being transmitted through the relatively large output gear and the relatively small output pinion gear before it is transmitted to the shaft lock mechanism. Or, stated another way, this arrangement allows the shaft lock mechanism to resist such back-torque with a "torque-amplified" resistance. This protects the shaft lock mechanism from breakage, as well as locating it more internally (at a position in the drive train that is internally-located relative to the output shaft) where it is better protected from dust or other external contaminants.

Additional objects, advantages, and features of the present invention will become apparent from the following description and the appended claims, taken in conjunction with the accompanying drawings.

DETAILED DESCRIPTION OF THE PREFERRED EMBODIMENTS

FIGS. 1 through 8 depict, for purposes of illustration only, a preferred example (and one exemplary variation) of the present invention as applied in an electric drill-type power driver tool. One skilled in the art will readily recognize, however, that the principles and features of the present invention are equally applicable to power driving tools of many other configurations, including, for example, those commonly referred to as "power screwdrivers".

Figure 1:
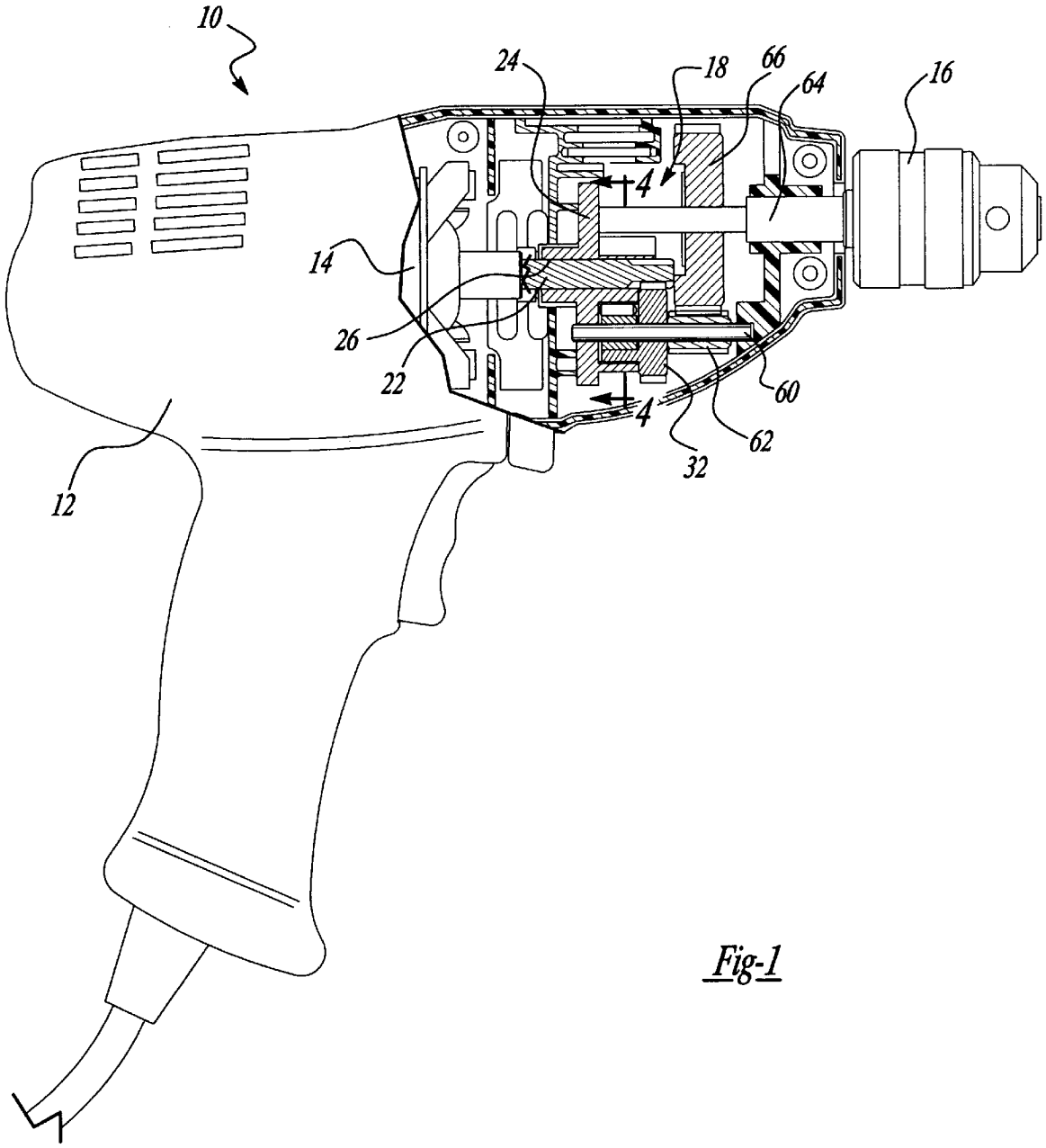
FIG. 1 is a side elevation view of an exemplary power driving tool incorporating the present invention, with portions of the tool's housing broken away to reveal internal components.
Figure 2:
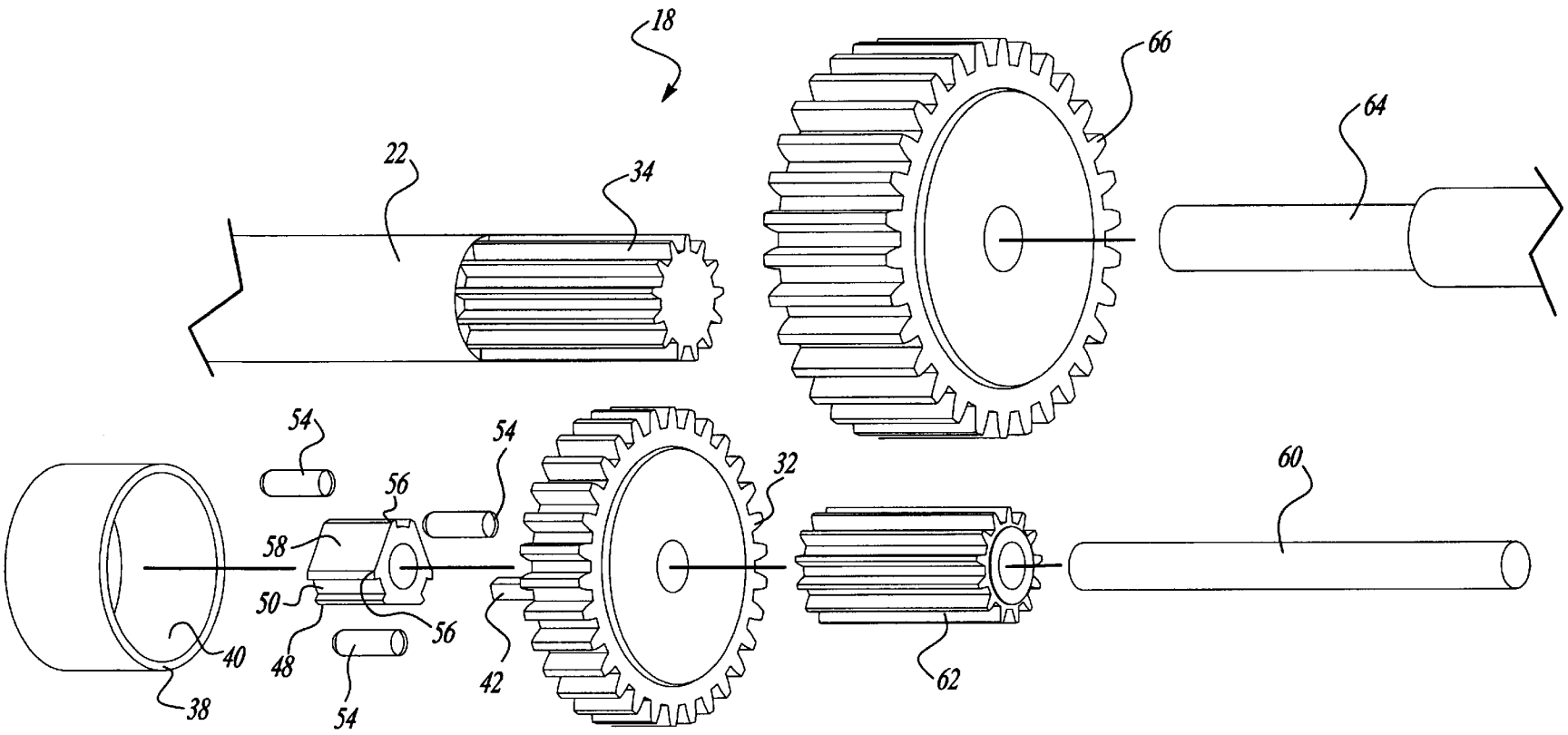
FIG. 2 is an exploded perspective view of the major components of the drive and automatic shaft mechanism.
Figure 3:
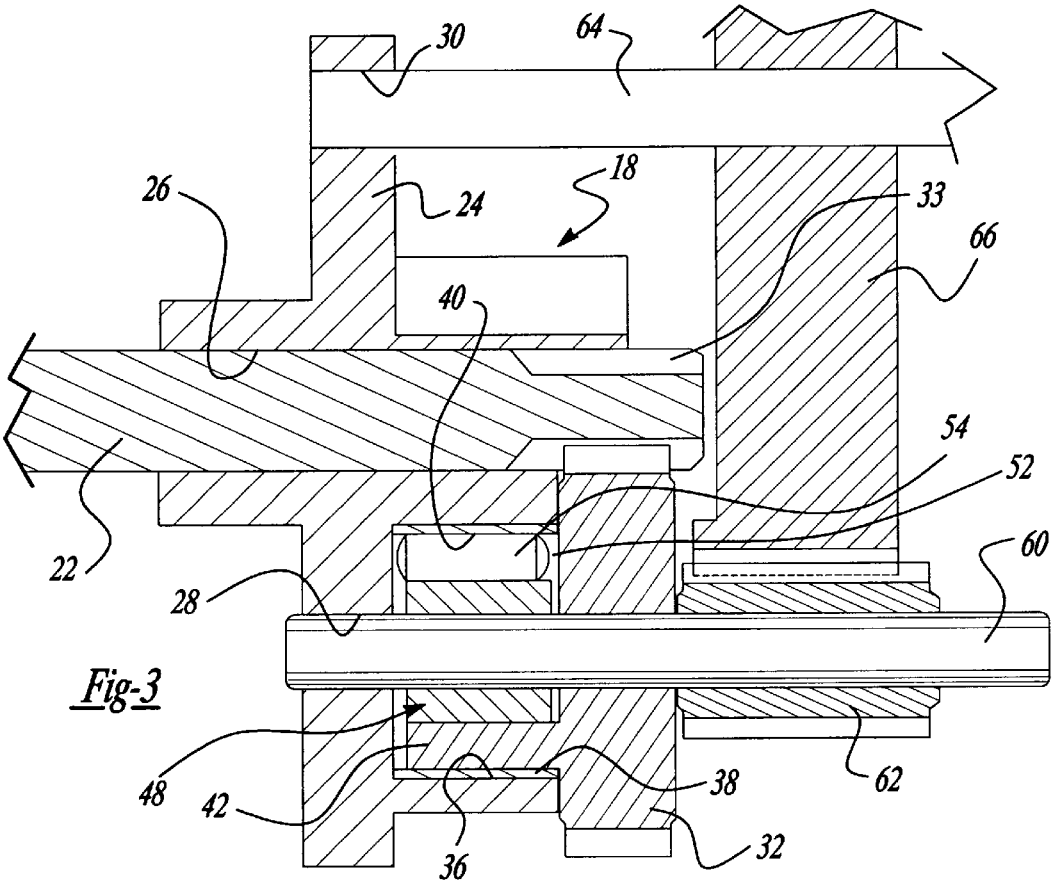
FIG. 3 is an enlarged side elevational cross-sectional view of the components of FIG. 2.

In FIG. 1, a power tool 10 includes a housing 12, within which is disposed a motor 14 and a drive mechanism 18 for transmitting power from the motor 14 to a chuck 16, which is adapted to drivingly hold a fastener driver bit, a drill bit, or other such rotating tool bit.

Referring to FIGS. 1 through 4, the drive mechanism 18 includes a motor armature shaft 22, preferably supported for rotation within a bearing plate 24 fixedly mounted within the tool's housing 12, with the bearing plate 24 preferably including a first bearing opening 26 for rotatably receiving the armature shaft 22, a second bearing opening 28 for rotatably receiving an intermediate shaft 60, and preferably a third bearing opening 30 for rotatably receiving an output shaft 64, with the output shaft 64 being drivingly interconnected with the chuck 16.

In the preferred exemplary embodiment depicted in the drawings, the armature shaft 22 has a geared end portion 34 thereon (or it can have a separate pinion gear fixedly mounted thereon), which is enmeshed with an intermediate gear 32 that is slip-fitted or otherwise mounted for free relative rotation about or on the intermediate shaft 60. The bearing plate 24 also includes a hollow cylindrical cavity 36 formed therein and preferably lined by a cylindrical sleeve 38, in order to form a hollow interior cavity surface 40 therein. At least one drive lug 42, and preferably a number of drive lugs 42, are formed on the intermediate gear 32. The drive lugs 42 extend axially or longitudinally into the hollow cylindrical cavity 36 radially adjacent the interior cavity surface 40, with the drive lugs 42 configured for concentric rotation with the intermediate gear 32. Each drive lug 42 has a radially inwardly-extending drive projection 44 thereon.

An anvil 48 is press-fitted or otherwise fixedly mounted on the intermediate shaft 60 for rotation therewith. As can perhaps best be seen in FIGS. 4 and 4*a*, the anvil 48 has at least one, and preferably a number, of axially-extending anvil channels 50 recessed radially inwardly therein about its circumferential periphery. The number of anvil channels 50 corresponds to the number of drive projections 44 on the drive lugs 42 of the intermediate gear 32, with the drive projections 44 being received within the anvil channels 50. Thus, the anvil 48, circumferentially adjacent pairs of drive lugs 42, and the interior cavity surface 40 of the hollow cylindrical cavity 36 (or the cylindrical sleeve 38) together form a number of circumferentially spaced-apart annular chambers 52.

Figure 4:
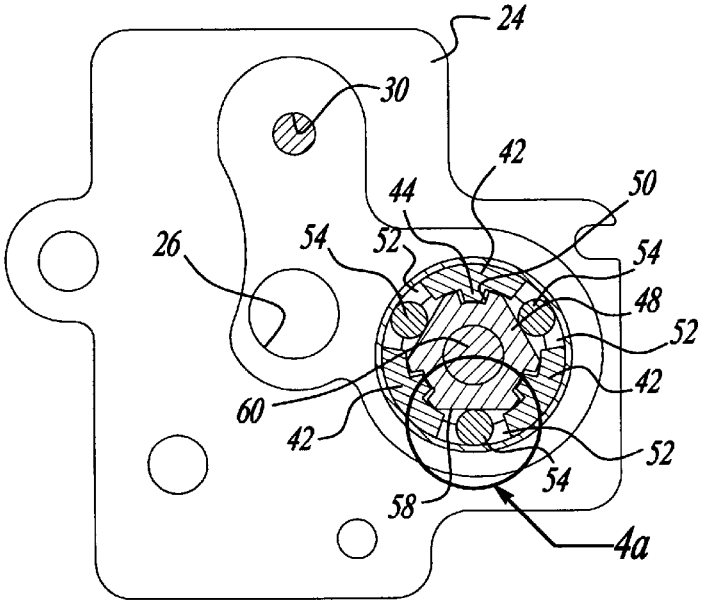
FIG. 4 is an end cross-sectional view of the components of FIGS. 2 and 3, taken generally along the line 4—4 of FIG. 1.
Figure 4A:
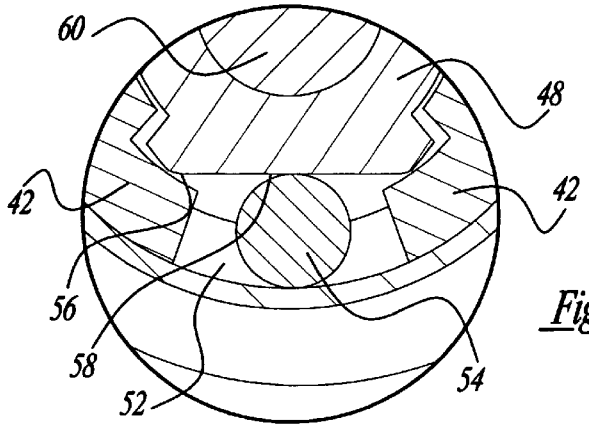
FIG. 4*a* is an enlarged view of the circled portion of FIG. 4.

Preferably, one cylindrical locking pin 54 is disposed within each chamber 52. The anvil 48 includes a generally flat anvil surface 58 generally at a circumferential midpoint between each set of adjacent anvil channels 50. In FIG. 4*a*, the preferred anvil 48 has each flat surface 58 positioned generally between radially outwardly-raised end portions or anvil bosses 56 closely adjacent the anvil channels 50. When the locking pins 54 are at this flat intermediate surface 58, they are less radially constrained between the anvil 48 and the interior cavity surface 40 than when they are at the radially outwardly-raised boss portions 56 (adjacent the anvil channels 50), as will be explained in more detail below.

Figure 4B:
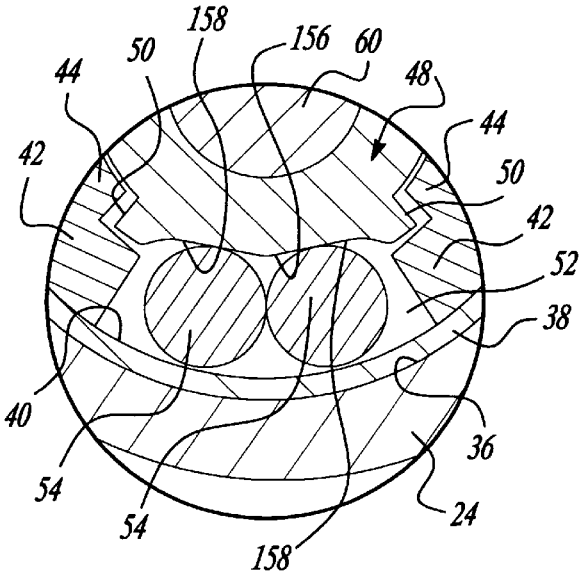
FIG. 4*b* is an enlarged view, similar to that of FIG. 4*a*, but illustrating an alternative embodiment of the invention.
Figure 5:
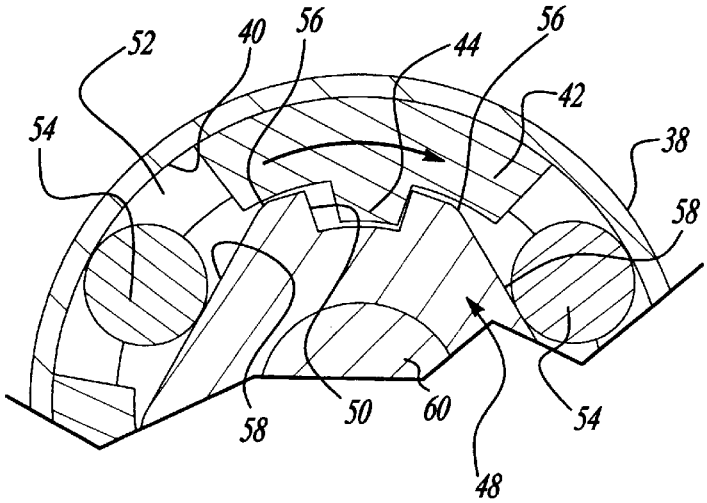
FIG. 5 is an enlarged detail view, similar to that of FIG. 4*a*, illustrating the preferred driving and shaft lock components during normal energization of the power tool for rotation in a first rotational direction.
Figure 6:
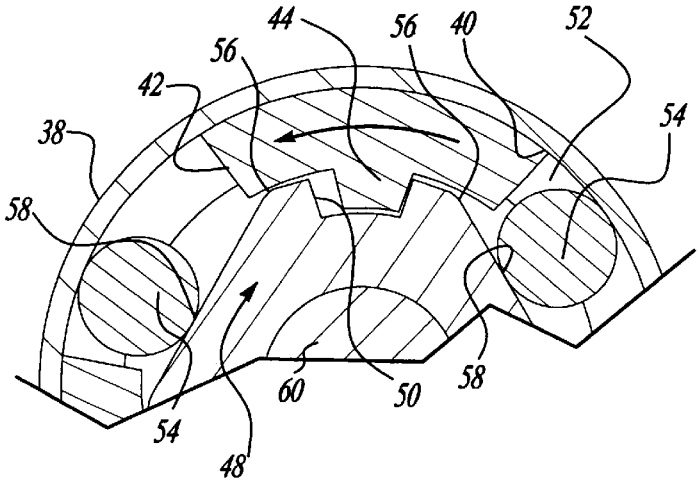
FIG. 6 is a detail view similar to that of FIG. 5, but illustrating the preferred components during normal driving rotation in a second, opposite rotational direction.
Figure 7:
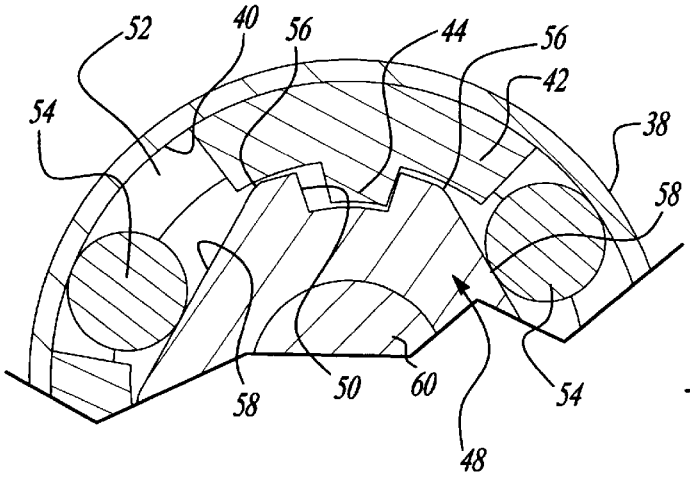
FIG. 7 is a view similar to that of FIG. 5, but further enlarged and illustrating the activation of the preferred automatic shaft lock feature of the present invention in response to an externally-applied back-torque in a rotational direction opposite to that of the driving rotational direction of FIG. 5.
Figure 8:
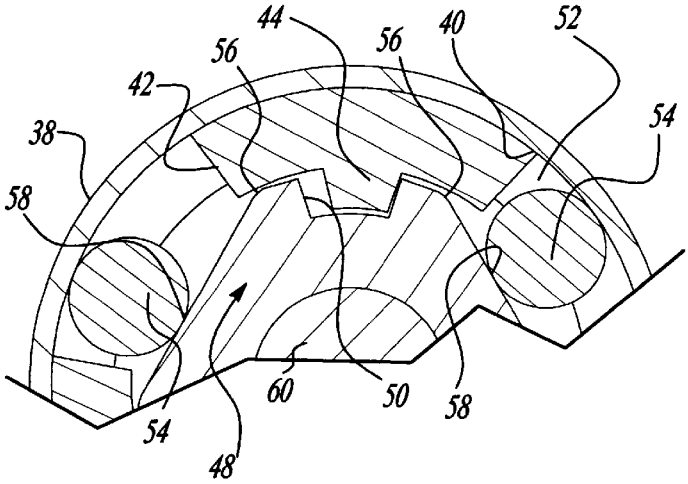
FIG. 8 is a view similar to that of FIG. 6, but further enlarged and illustrating the activation of the preferred automatic shaft lock feature of the present invention in response to an externally-applied back-torque in a rotational direction opposite to that of the driving rotational direction of FIG. 6.

FIG. 4*b* illustrates an alternate variation, in which the single locking pin 54 in each chamber 52 is replaced by two (or more) locking pins 154 in each chamber 52. In this alternate embodiment, a somewhat "peaked" anvil cam surface 156 protrudes radially outwardly between adjacent flats 158 to provide a radially-constructed area for the pins 54.

Referring to FIGS. 2 through 5, it can be readily seen that when the power tool's motor 14 is energized in order to cause rotation of the armature shaft 22, the intermediate gear 32 is therefore caused to rotate in a rotational direction opposite that of the armature shaft 22. This forward-torque rotation of the intermediate gear 32 causes a corresponding, concentric rotation of the intermediate gear's drive lugs 42, whose interlocking drive projections 44 contact the corresponding sides of the anvil channels 50, urging them in a first rotational direction and causing a same-direction rotation of the anvil 48. Since the anvil 48 is press-fitted or otherwise fixedly mounted on the intermediate shaft 60, the intermediate shaft 60 also rotates in the same rotational direction as the intermediate gear 32. An output pinion gear 62 is preferably press-fitted or otherwise rotationally fixed to the intermediate shaft 60 and is enmeshed with an output gear 60 rotationally fixed to the output shaft 64, thereby transmitting rotational force to the tool's chuck 16.

Since many, if not most, power driving tools of the exemplary type described herein are "reversible", that is being adapted for power driving in either of two opposite forward-torque rotational directions, the drive mechanism 18 (and the automatic shaft lock) of the exemplary embodiment depicted herein is adapted for such reversible rotation. As is illustrated with reference to FIGS. 2 through 4*a* and 6, the intermediate gear 32, the drive lugs 42, and the drive projections 44 rotate in the opposite rotational direction of that of FIG. 5. Thus, in a similar manner as is discussed above in connection with FIG. 5, the drive lugs 42 and the drive projections 44 cause such opposite rotation of the anvil 48, by way of the interlocking engagement between the drive projections 44 and the opposite sides of the anvil channels 50 from that of FIG. 5. Similarly, in FIG. 6, this causes a similar opposite forward-torque rotation of the locking pins 54 by way of contact with the opposite circumferential sides of the drive lugs 42 from that of FIG. 5.

In the event that the power tool 10 is used for manually applying a rotational driving force to the chuck 16 (and thus to the driven bit held by the chuck 16), a resultant back-torque or rotational back-force is applied to the output shaft 64, and thus to the output pinion gear 62 and the intermediate gear 32 in either of two reversible rotational directions opposite to the rotational forward-torque force being imposed by the motor 14 and the armature shaft 22 (in the case where the power tool is energized). Even when the power tool 10 is not energized, such resultant externally-applied rotational back-torque or rotational back-force is similarly imposed on the intermediate shaft 60. In either of these instances, the armature shaft 22 and the intermediate gear 32 are either stationary or are subjected to rotational forces opposite to the direction of the externally-applied rotational back-force or back-torque imposed on the intermediate shaft 60. Because the anvil 48 is press-fitted or otherwise rotationally fixed to the intermediate shaft 60, the back-torque imposed on the intermediate shaft 60 will also be transferred to the anvil 48, causing it to rotate a small amount. However, the drive projections 44 of the drive lugs 42 do not correspondingly rotate due to the circumferential clearance within the anvil channels 50. Thus, since the locking pins 54 are not forcibly urged in a circumferential direction by contact with the circumferential sides of the drive lugs 42 so that they would remain in the radially relatively unconstrained area of the chambers 52 adjacent the anvil flats 58, such small amount of rotation of the anvil 48 causes the locking pins 54 to be urged radially outwardly by one of the radially outwardly raised boss portions 56 of the anvil adjacent the anvil channels 50 on opposite circumferential ends of the flat anvil surface 58. This causes the locking pins 54 to be tightly pinched or wedged into one of the radially constricted areas of the anvil chambers 52 (between one of the radially outwardly raised boss portions 56 of the anvil and the interior cavity surface 40 of the hollow cylindrical cavity 36 or of the cylindrical sleeve 38). This wedging or pinching action therefore effectively locks the anvil against further rotation and thus also locks the intermediate shaft 60, the output pinion 62, the output gear 66, and thus the tool's output shaft 64.

It should be noted that the above-described automatic shaft locking effect occurs whenever the tool's output shaft 64 is acted upon by an externally applied manual rotational back-torque or back-force acting in either direction of rotation. However, as described above, when the tool's motor 14 is energized to drive the armature shaft 22, the anvil 48 is free to rotate in either driven rotational direction. Thus, the direction of rotation of the anvil 48 is not determinative of whether the anvil 48 will be locked. Rather, the determinative factor in automatic shaft locking is whether the torque on the anvil 48 is applied in a forward-torque direction by way of the motor 14 and the armature shaft 22 (in the unlocked, normal driving operation), or in a back-torque or back-force direction by way of the tool's output shaft 64 (in the automatic shaft-locking condition). A similar wedging of the pins 54 is caused in the alternate arrangement of FIG. 4*b* by the peak portions 156.

In addition, in either arrangement, since the output gear 66 is much larger than the output pinion 62 in most applications of the present invention, the back-torque transmitted to the intermediate shaft is reduced from that of the back-torque imposed on the output shaft 64, thus further protecting the driving and interlocking transmission components and preventing such high back-torque from the output shaft 64 from being imposed on the armature shaft 22 by way of the intermediate gear 32. Therefore, as mentioned above, this results in such back-torque being effectively resisted by a torque-amplifying resistance applied through the intermediate shaft by the shaft lock mechanism.

In addition, it should be noted that this effect also results from the automatic shaft lock being in a drive position between the intermediate gear 32 (which is driven by the armature shaft 22 through its geared portion 34 or an armature pinion thereon) and the output shaft 66 (which is in a driving engagement with the intermediate shaft 60). This arrangement of the present invention is in direct contrast with the typical prior art arrangement, such as that shown in the above-mentioned U.S. Pat. No. 5,016,501, wherein the shaft lock mechanism is on the output shaft. The above-described arrangement of the present invention offers the distinct advantage of the above-described reduction of the back-torque imposed from the output gear 66 through the output pinion gear 62 to the automatic shaft lock mechanism, thus protecting the shaft lock mechanism and making it more effective. This arrangement of the present invention also offers the advantage of the shaft lock mechanism being better protected from dust or other external contamination.

The foregoing discussion discloses and describes merely exemplary embodiments of the present invention for purposes of illustration only. One skilled in the art will readily recognize from such discussion, and from the accompanying drawings and claims, that various changes, modifications, and variations can be made therein without departing from the spirit and scope of the invention as defined in the following claims.

What is claimed:

1. A power tool having a drive train and a housing, said drive train including an axially-extending rotatable armature shaft enmeshed with an intermediate gear disposed in the housing for bi-directional forward-torque rotation in response to bi-directional forward-torque rotation of the armature shaft, an intermediate shaft disposed in the housing for rotation therein, said intermediate shaft being drivingly interconnected with an output shaft, and a shaft lock mechanism adapted for rotationally interconnecting the intermediate shaft with the intermediate gear in order to cause rotation of the intermediate shaft in a forward-torque direction in response to rotation of the intermediate gear and adapted for preventing rotation of the intermediate gear in response to an externally-applied rotational back-torque imposed on the intermediate shaft in a second opposite back-torque direction, said shaft lock mechanism being drivingly located in said drive train between said intermediate gear and said intermediate shaft, said intermediate shaft having an output pinion fixed thereon for rotation therewith, said output shaft having an output gear fixed thereon for rotation therewith and enmeshed in a driving relationship with said output pinion, said output gear being larger than said output pinion to reduce the magnitude of said back-torque being transmitted to said shaft lock mechanism.

2. A power tool according to claim 1, further having a bearing plate fixedly disposed within the housing, said bearing plate having a hollow cavity therein, said shaft lock mechanism being disposed within said hollow cavity.

3. A power tool having a housing, an axially-extending rotatable armature shaft enmeshed with an intermediate gear disposed in the housing for bi-directional forward-torque rotation in response to bi-directional forward-torque rotation of the armature shaft, an intermediate shaft disposed in the housing for rotation therein, an output shaft, and a shaft lock mechanism adapted for rotationally interconnecting the intermediate shaft with the intermediate gear in order to cause rotation of the intermediate shaft in a first forward-torque direction in response to rotation of the intermediate gear and adapted for preventing rotation of the intermediate gear in response to an externally-applied rotational back-torque imposed on the intermediate shaft in a second opposite back-torque direction, said shaft lock mechanism comprising:

a hollow cylindrical cavity formed in a fixed portion of the housing radially offset relative to the armature shaft and having a cylindrical interior cavity surface therein;

at least one drive lug fixedly disposed on the intermediate gear for concentric rotation therewith and extending axially into said hollow cylindrical cavity generally adjacent the radially-outward periphery thereof, said drive lug having a drive projection extending radially inwardly therefrom;

an anvil fixedly disposed on the intermediate shaft for concentric rotation therewith and disposed with said cavity, said anvil having an external diameter smaller than the diameter of said interior cavity surface of said hollow cylindrical cavity, said anvil further having at least one axially-extending anvil channel recessed radially inwardly therein for receiving said radially inwardly-extending drive projection therein in a driving relationship therewith, said anvil channel having a circumferential width greater than the circumferential width of said drive projection to permit a predetermined amount of limited relative rotation therebetween;

an annular chamber within said cylindrical cavity defined by said drive lug, said anvil and said interior cavity surface;

an axially-extending cylindrical locking pin disposed within said chamber between said anvil and said interior cavity surface of said hollow cylindrical cavity; and a radially outwardly raised boss surface on said anvil protruding radially outwardly into said chamber, said raised boss surface being circumferentially spaced from said drive lug on said intermediate gear, said locking pin and said anvil being free to rotate in response to forward-torque rotation of said drive lug, forward-torque rotation of the intermediate gear and forward-torque rotation of said anvil in response to bi-directional forward-torque rotation of the intermediate gear being driven by the armature shaft, and said anvil rotating relative to said drive projection in order to radially outwardly wedge said locking pin between said raised boss surface and said interior cavity surface in response to said externally-applied rotational back-torque imposed on the intermediate shaft in said second opposite back-torque direction, thereby preventing transmission of said externally-applied rotational back-torque from said intermediate shaft and said anvil to the intermediate gear and the armature shaft, said intermediate shaft being drivingly interconnected with said output shaft by an output gear mechanism, said output gear mechanism reducing the magnitude of said back-torque being transmitted back to said shaft lock mechanism.

4. A power tool according to claim 3, wherein said intermediate gear includes a number of said drive lugs spaced circumferentially thereon, said anvil having a number of said anvil channels spaced circumferentially thereon corresponding to the number of said drive lugs, said interlock and shaft lock mechanism further including a number of said locking pins, each of said locking pins being disposed between two circumferentially-adjacent drive lugs, said anvil having a generally flat exterior surface portion between a pair of said raised surfaces, each of said raised surfaces being generally adjacent one of said anvil channels.

5. A power tool according to claim 4, wherein two of said locking pins are disposed circumferentially adjacent one another between each pair of circumferentially adjacent drive lugs.

6. A power tool according to claim 3, further including a bearing plate fixedly disposed within the housing, said hollow cylindrical cavity being formed in said bearing plate.

7. A power tool according to claim 6, wherein a hollow cylindrical sleeve is disposed within said hollow cylindrical cavity thereby forming said interior cavity surface therein.

8. A power tool according to claim 3, wherein said intermediate gear is mounted for free relative concentric rotation on said intermediate shaft.

9. A power tool having a housing, axially-extending rotatable armature shaft extending through an armature bearing opening in a bearing plate fixed to the housing, the armature shaft being disposed for bi-directional forward-torque rotation therein and having an armature gear thereon, an intermediate gear disposed in the housing and enmeshed with the armature gear for bi-directional forward-torque rotation in response to rotation of the armature gear, an intermediate shaft disposed in the housing for bi-directional rotation therein and an output shaft; said intermediate gear being mounted for free relative concentric rotation on said intermediate shaft, and an interlock mechanism for rotationally interconnecting the intermediate shaft with the intermediate gear for rotation of the intermediate shaft in a first forward-torque bi-direction in response to rotation of the intermediate gear and for preventing rotation of the intermediate gear in response to an externally-applied rotational back-torque imposed on the intermediate shaft in a second opposite back-torque bi-direction, said interlock mechanism comprising:

a hollow cylindrical cavity formed in the bearing plate at a radially offset position relative to the armature bearing opening and having a cylindrical interior cavity surface therein;

a number of drive lugs fixedly disposed on the intermediate gear and extending longitudinally into said hollow cylindrical cavity adjacent the radially-outward periphery thereof, said drive lugs each having a drive projection extending radially inwardly therefrom;

an anvil fixedly disposed on the intermediate shaft for concentric rotation therewith and disposed with said cavity, said anvil having an external diameter smaller than that of said interior cavity surface of said hollow cylindrical cavity so as to be spaced radially inwardly therefrom, said anvil having a number of longitudinally-extending anvil channels recessed radially inwardly therein and opening outwardly therefrom, each anvil channel receiving one of said radially inwardly-extending drive projections therein in a driving relationship therewith, said anvil channels having circumferential widths greater than that of said drive projection to permit predetermined limited amount of relative rotation therebetween;

said drive lugs, said anvil and said interior cavity surface defining a number of circumferentially spaced-apart chambers within said radial space in said cylindrical cavity, a longitudinally-extending cylindrical locking pin disposed within each of said chambers;

said anvil further having a radially outwardly-raised boss surface thereon extending radially outwardly into each of said chambers, each of said raised boss surfaces being disposed generally adjacent one of said channels formed in said anvil, one of said locking pins being disposed circumferentially between circumferentially adjacent ones of said raised boss surfaces;

said locking pins and said anvil being free to rotate in response to forward-torque rotation of said drive lugs, forward-torque rotation of the intermediate gear, and forward-torque rotation of said anvil in response to rotation of the intermediate gear being driven by the armature shaft, and said anvil rotating relative to said drive projections to a predetermined limited amount in order to radially outwardly wedge said locking pins between one of said raised boss surfaces and said interior cavity surface in response to said externally-applied rotational back-torque imposed on the intermediate shaft and said anvil in said second opposite back-torque bi-direction in order to thereby prevent transmission of said externally-applied rotational back-torque from said intermediate shaft and said anvil to the intermediate gear and the armature shaft; and said intermediate shaft being drivingly interconnected with said output shaft by an output gear mechanism, said output gear mechanism reducing the magnitude of said back-torque being transmitted back to said interlock mechanism.

10. A power tool according to claim 9, wherein said intermediate gear includes three of said drive lugs thereon, said anvil correspondingly having three of said anvil channels therein, thus defining three of said chambers, and at least one of said locking pins being disposed in each of said chambers between each pair of circumferentially adjacent drive lugs.

11. A power tool according to claim 10, wherein two of said locking pins are disposed circumferentially adjacent one another between each pair of circumferentially adjacent drive lugs.

12. A power tool according to claim 11, wherein a hollow cylindrical sleeve is disposed within said hollow cylindrical cavity thereby forming said interior cavity surface therein.

13. A power tool according to claim 12, wherein said locking pin is wedged between one of said raised boss surfaces and said interior cavity surface in response to said predetermined limited relative rotation of said anvil relative to said drive projection, thereby restricting the radial space between said anvil and said interior cavity surface in which said locking pin is disposed.

* * * * *